US007363747B2

(12) United States Patent
Heck et al.

(10) Patent No.: US 7,363,747 B2
(45) Date of Patent: Apr. 29, 2008

(54) HIGH STRUCTURAL LOAD WINDOW SASH LATCH

(75) Inventors: Ed Heck, Belpre, OH (US); Jimmie D. Daniels, Jr., Harrisville, WV (US)

(73) Assignee: Simonton Building Products, Inc., Parkersburg, WV (US)

( * ) Notice: Subject to any disclaimer, the term of this patent is extended or adjusted under 35 U.S.C. 154(b) by 184 days.

(21) Appl. No.: 11/029,855

(22) Filed: Jan. 5, 2005

(65) Prior Publication Data

US 2005/0144845 A1 Jul. 7, 2005

Related U.S. Application Data

(60) Provisional application No. 60/534,582, filed on Jan. 6, 2004.

(51) Int. Cl.
*E05D 15/22* (2006.01)

(52) U.S. Cl. ..... 49/185

(58) Field of Classification Search ..... 49/283, 49/184, 185; 292/DIG. 20, DIG. 33, DIG. 35, 292/DIG. 47, DIG. 73
See application file for complete search history.

(56) References Cited

U.S. PATENT DOCUMENTS

| | | | | |
|---|---|---|---|---|
| 3,288,509 | A * | 11/1966 | Galena | 292/238 |
| 4,955,159 | A * | 9/1990 | Rogers | 49/161 |
| 5,274,955 | A * | 1/1994 | Dallaire et al. | 49/406 |
| 6,021,603 | A * | 2/2000 | Prete et al. | 49/183 |
| 6,948,278 | B1 * | 9/2005 | Schultz | 49/185 |
| 7,069,694 | B2 * | 7/2006 | Fullick | 49/183 |
| 2004/0128916 | A1 | 7/2004 | Fullick | |
| 2005/0028446 | A1 | 2/2005 | Fullick | |

* cited by examiner

*Primary Examiner*—Jerry Redman
(74) *Attorney, Agent, or Firm*—Cesari and McKenna, LLP

(57) ABSTRACT

A high structural load window sash latch includes a load applying housing wrap that extends around the interior face of a window sash. The housing wrap transfers the majority of positive forces incident upon the sash to a latch housing, where the forces are transferred to a latch bolt and then to the window jamb. Further, two load-bearing screws also secure the latch housing to the sash, while a hold down screw prevents the housing from lifting.

20 Claims, 6 Drawing Sheets

HIGH STRUCTURAL LOAD WINDOW SASH LATCH

CROSS-REFERENCE TO RELATED APPLICATION

The present application claims the benefit of U.S. Provisional Patent Application Ser. No. 60/534,582, which was filed on Jan. 6, 2004, by Ed Heck and Jimmie D. Daniels, Jr. for a HIGH STRUCTURAL LOAD WINDOW SASH LATCH and is hereby incorporated by reference.

BACKGROUND OF THE INVENTION

1. Field of the Invention

The invention relates generally to the construction of exterior windows suitable for use in commercial or residential buildings. In particular, the invention relates to a latching mechanism for window sashes that allows the sashes to withstand high forces, such as the wind forces that occur during storms.

2. Background Information

Exterior windows are designed to provide a weather-tight barrier against the elements. During most weather conditions, windows are subject to only nominal forces. These forces can easily be withstood by conventional window designs. Yet, during severe weather, exterior windows may be subject to much greater forces. A category 1 hurricane, the least severe type according to the Saffir-Simpson scale, produces winds in excess of 74 mph. A category 4 hurricane, a more severe type, can produce winds up to 155 mph. Similarly, a mild category F-0 tornado (according to the Fujita scale), produces winds of up to 72 mph, while more powerful tornadoes can generate winds of 260 mph or more.

High speed winds may exert large forces against an exterior window. The magnitude of a wind force is proportional to the square of the wind speed, causing wind force to increase rapidly as wind speed increases. Wind typically exerts two types of force on an exterior window. The first type, a sustained force, is an almost constant force that may last, for example, up to a minute or more. The second type, an intermittent force, is a momentary force created by a higher-speed wind gust and may last up to a few seconds.

Sustained and intermittent forces are often exerted upon exterior windows in multiple directions. Generally, wind blowing against a building creates a positive force (an inward force) on the windward side of the building and a negative force (an outward or suction force) on the leeward side of the building. Depending on the shape of the building, negative forces may also be exerted on walls parallel to the wind. As wind direction shifts, placement of positive and negative forces constantly changes.

Conventional window designs are often ill suited to withstand the severe forces created by hurricanes and tornadoes. While glass breakage is the most common mode of failure, window sashes and frames themselves may fail under force. When a window is subject to extreme forces, a window sash may dislodge from the window jamb. This problem is particularly acute in double-hung windows where the sash travels in a track or channel, and is not attached to the jamb by hinges or other fasteners. Once dislodged from the jamb, a sash may be blown into, or out of, the building, potentially injuring occupants of the building or passersby. Further, wind and water may enter the building through the window opening, damaging the building and its contents.

Latching mechanisms have been designed that purport to better secure window sashes to their jambs. Some of these latching mechanisms employ a bolt device that extends into the window jamb. While providing some benefit, these previous designs have suffered from poor performance. Under high forces, the prior latching mechanisms have tended to lift and separate from sashes, often allowing their bolts to break free and dislodge. When this occurs, the sash may be blown from the jamb despite the latching mechanism.

What is needed is an improved window sash latch that more effectively secures a window sash to a window jamb than the prior designs. Such a window sash latch should better withstand forces incident upon the window sash, and demonstrate superior resistance to separation from the sash. An improved window sash latch must also be easy to operate and relatively inexpensive to manufacture.

SUMMARY OF THE INVENTION

The disadvantages of prior window sash latches are overcome by providing a high structural load window sash latch that more effectively transfers forces from a window sash to a window jamb. The new window sash latch consists of a spring-loaded latch bolt that interfaces with the jamb, and a novel housing made from impact-resistant materials. The housing includes a load applying housing wrap that is essentially an extension of the housing that curves around an interior portion of the window sash and absorbs the majority of the positive forces incident upon the sash. These forces are then transferred into the rest of the housing, and, in turn, to the latch bolt and the window jamb.

The high structural load window sash latch may be further held in place by a hold-down screw positioned on the exterior side of the housing, close to where the window sash meets the window jamb. The hold-down screw prevents the housing from lifting away from the sash in response to forces, thus retaining the latch bolt in place and preventing it from sliding under, and out of, the housing. Two additional load bearing screws, located on the interior side of the housing, transfer negative forces incident upon the sash to the housing.

The novel window sash latch effectively transfers forces from the window sash to the window jamb, and thus reduces the risk of a sash dislodging during severe weather. Further, the window sash latch may be employed with conventional sashes, or with sashes that have other structural features suited for withstanding wind forces, such as interlocking meeting rails.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
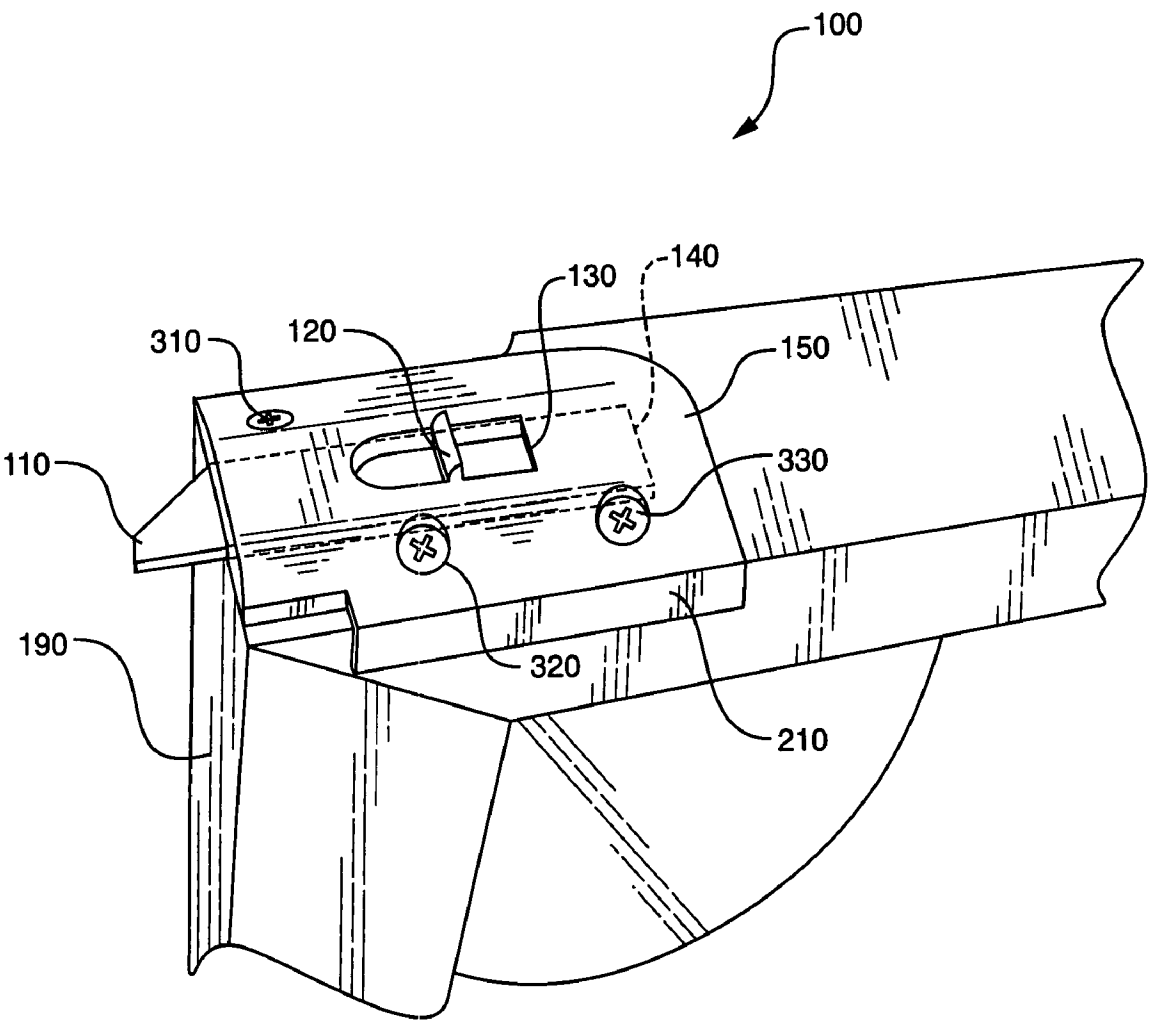
FIG. 1 is a perspective view of a high load window sash latch secured to a window sash, as viewed from the interior face of the window sash.

FIG. 1 is a perspective view of a high load window sash latch 100 secured to a window sash 190, as viewed from the interior face of the window sash. The window sash latch includes a housing 150 with a housing wrap 210 that curves around an interior portion of the window sash. These features are discussed in detail below.

The high load window sash latch further includes a movable latch bolt 110 that slides horizontally in a channel 140 (shown in dashed lines), formed in the housing 150. In one embodiment, the bottom surface of the latch bolt 110 may rest directly upon, and slide along, the top of the window sash. Alternatively, the housing 150 may completely enclose the latch bolt 110, so that latch bolt 110 does not contact the window sash.

Figure 4:
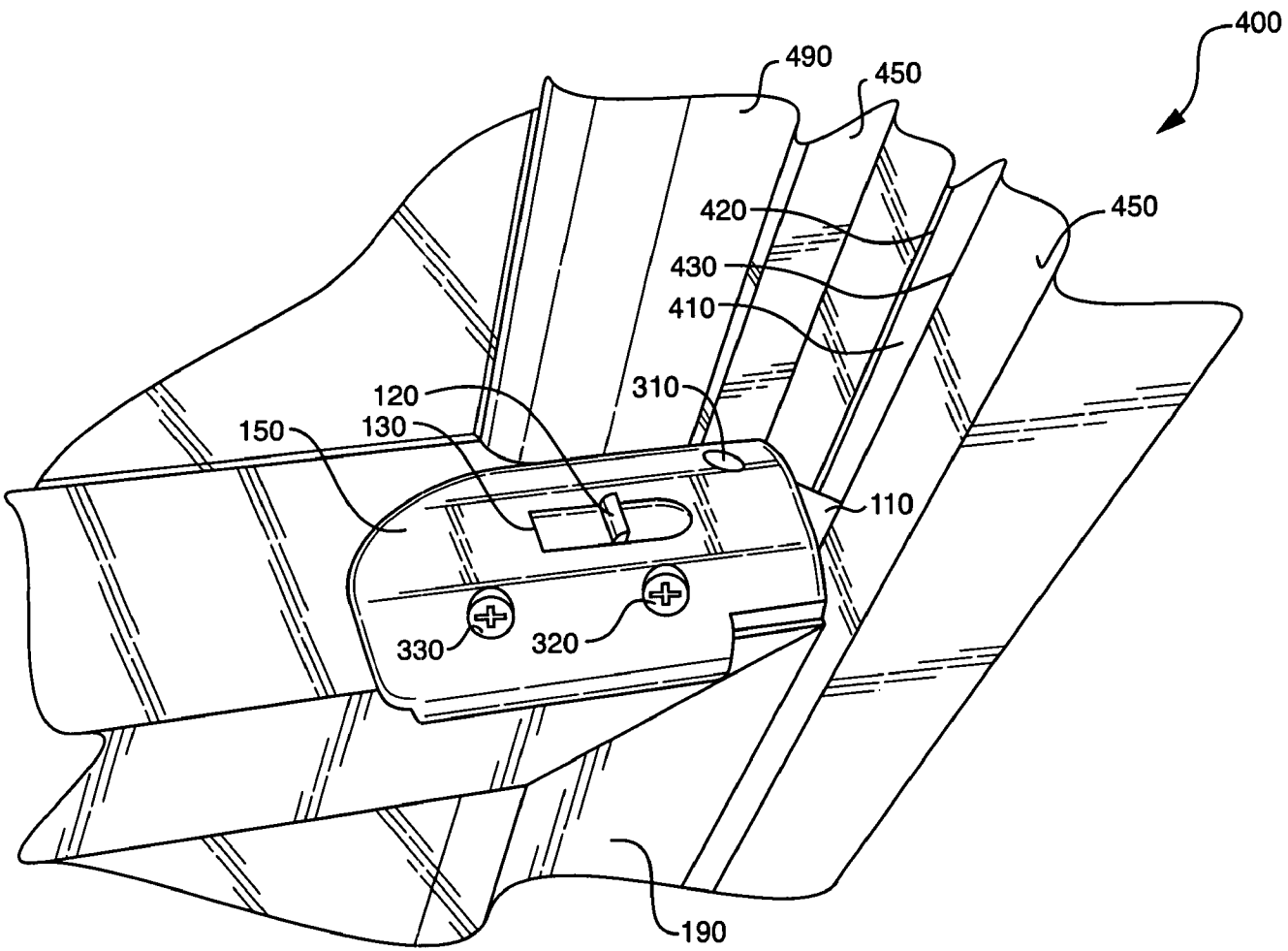
FIG. 4 is a perspective view of a window with upper and lower sashes, as viewed from the interior faces of the window sashes, and illustrates the operation of the high load window sash latch.

The latch bolt 110 may slide inward, so that at one extreme the bolt is retracted close to the side of the window sash 190, allowing the top of the sash to be tilted out for cleaning or other purposes. Likewise, the latch bolt 110 may slide outward, so that, at another extreme, the bolt is extended into the window jamb 450 (FIG. 4). While extended, the bolt interfaces with the window jamb and serves to hold the sash in place against tilting and impact forces. The latch bolt 110 is preferably affixed to a spring 160 (shown in dashed lines) that holds the latch bolt in its extended position absent any user efforts. When desired, a user may slide the latch bolt 110 against the force of the spring, and hold the bolt in its retracted position, by using a finger pull 120 formed into the top surface of the latch bolt 110. The finger pull 120 may be easily accessed through an opening 130 in the housing 150.

Figure 2:
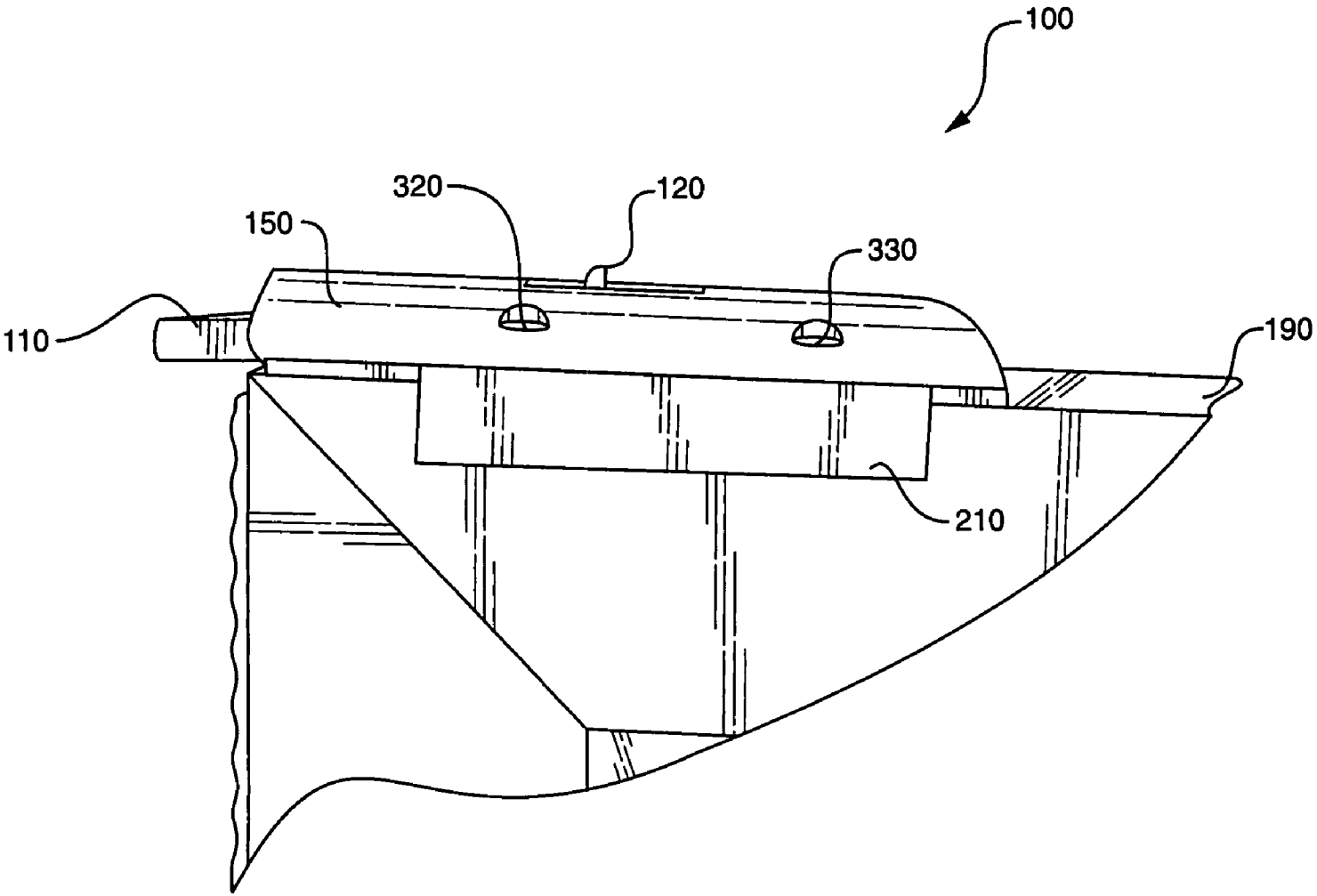
FIG. 2 is a side elevation of a high load window sash latch secured to window sash, as viewed from the interior face of the window sash, showing in particular the is housing wrap.

FIG. 2 is a side elevation of a high load window sash latch 100 secured to a window sash 190 as viewed from the interior face of the sash. As shown, the housing wrap 210 is formed as an integral part of the housing 150, and extends around and down a portion of the interior face of the sash 190. The housing wrap 210 is thus positioned to receive the majority of positive forces (inward directed forces) incident upon the window sash. Accordingly, when a positive force is exerted upon the sash, the sash 190 pushes against the housing wrap 210, and the force is dispersed through the rest of the housing 150 to the latch bolt 110, and eventually to the window jamb.

Figure 3:
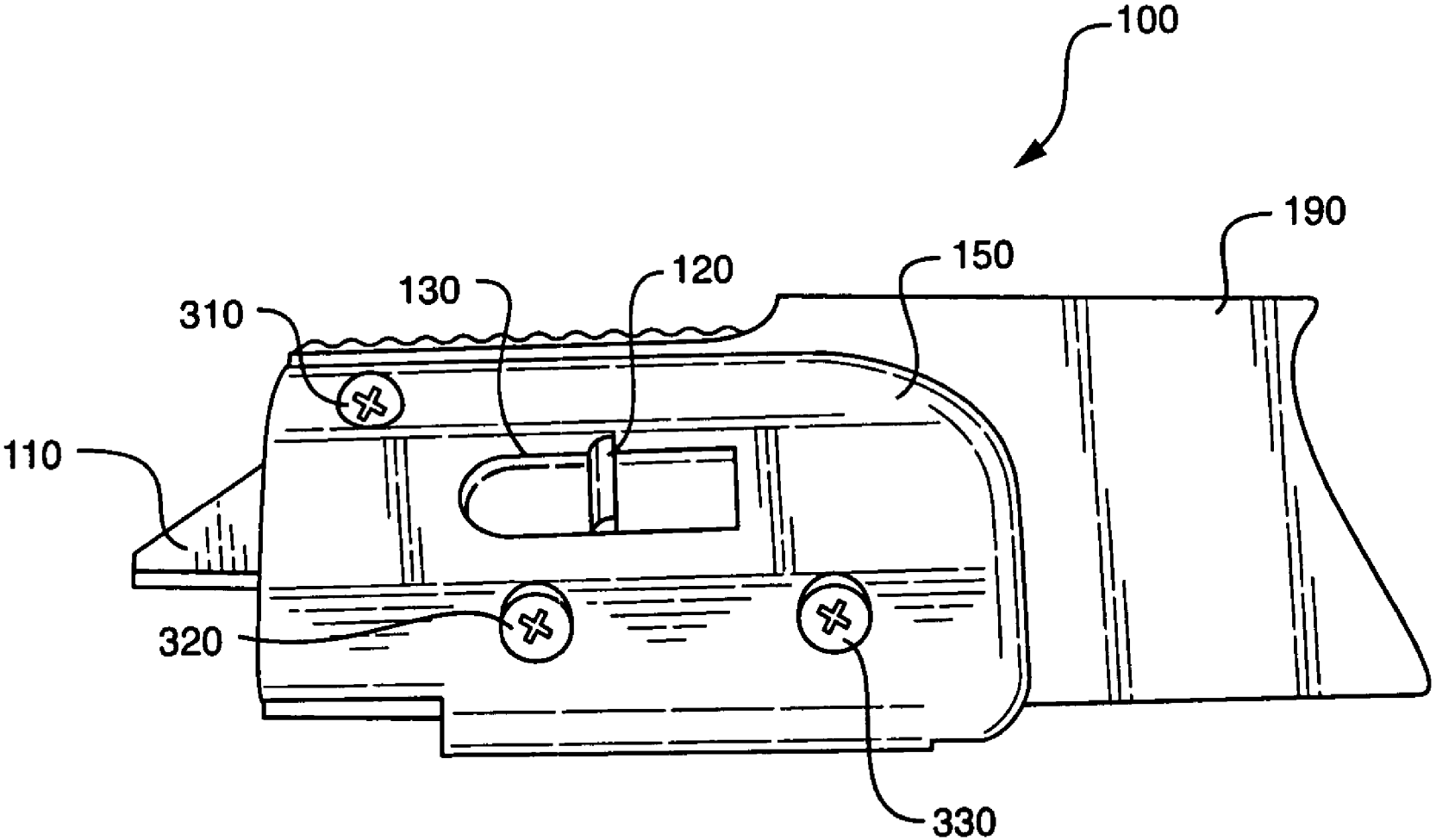
FIG. 3 is a top elevation of a high load window sash latch secured to window sash, showing in particular the hold-down screw and the load-bearing screws.

FIG. 3 is a top elevation of the high load window sash latch secured to a window sash. As previously described, the housing 150 essentially surrounds the latch bolt 110 and transfers forces incident upon the sash 190 to the latch bolt. A hold-down screw 310 extends through the housing 150 near the exterior face of the window sash 190 and holds the exterior side of the housing in-place. The exterior side of the housing 150, proximate to the window jamb, is generally subject to the greatest lifting forces. Thus, the hold is down screw 310 is advantageously positioned near the window jamb to resist these forces and prevent the housing from lifting. If the housing were allowed to lift, the latch bolt could move out of the channel 140 and become disconnected from the housing. The sash would then be free to dislodge from the window jamb.

The housing 150 is further secured to the sash by two load-bearing screws 320, 330 located parallel to the interior face of the window sash 190. These screws may transfer negative forces incident on the window sash to the housing, which then transfers the forces to the latch bolt.

As discussed above, the housing wrap 210 effectively transfers the majority of positive forces from the window sash to the housing. Consequently, the housing may be held in place by screws that attach to hollow (non-reinforced) ends of the window sash. Prior window sash latch designs have required additional internal reinforcement bars be placed inside hollow window sashes, such that the prior window sash latches could fasten into these bars. By eliminating the need for the reinforcement bars (not shown) to extend into the mitered corners of the sash, the sash 190 may be constructed in a less time consuming and less costly manner.

FIG. 4. is a perspective view of a portion of a window with upper and lower window sashes 490, 190 and illustrates the operation of the high load window sash latch. The window sashes 490, 190 move vertically within a window jamb 450 that includes a track 410 that receives the latch bolt 110. The track 410 extends the height of the window jamb, enabling the window sash 190 a full range of vertical movement. While allowing vertical movement, the track 410 also prevents unwanted inward or outward movement of the latch bolt, with horizontal legs 420, 430 of the track restraining the bolt's movement. Any forces incident upon the window sash are thus transferred into the horizontal legs of the track 420, 430 and on to the rest of the window jamb.

Figure 5:
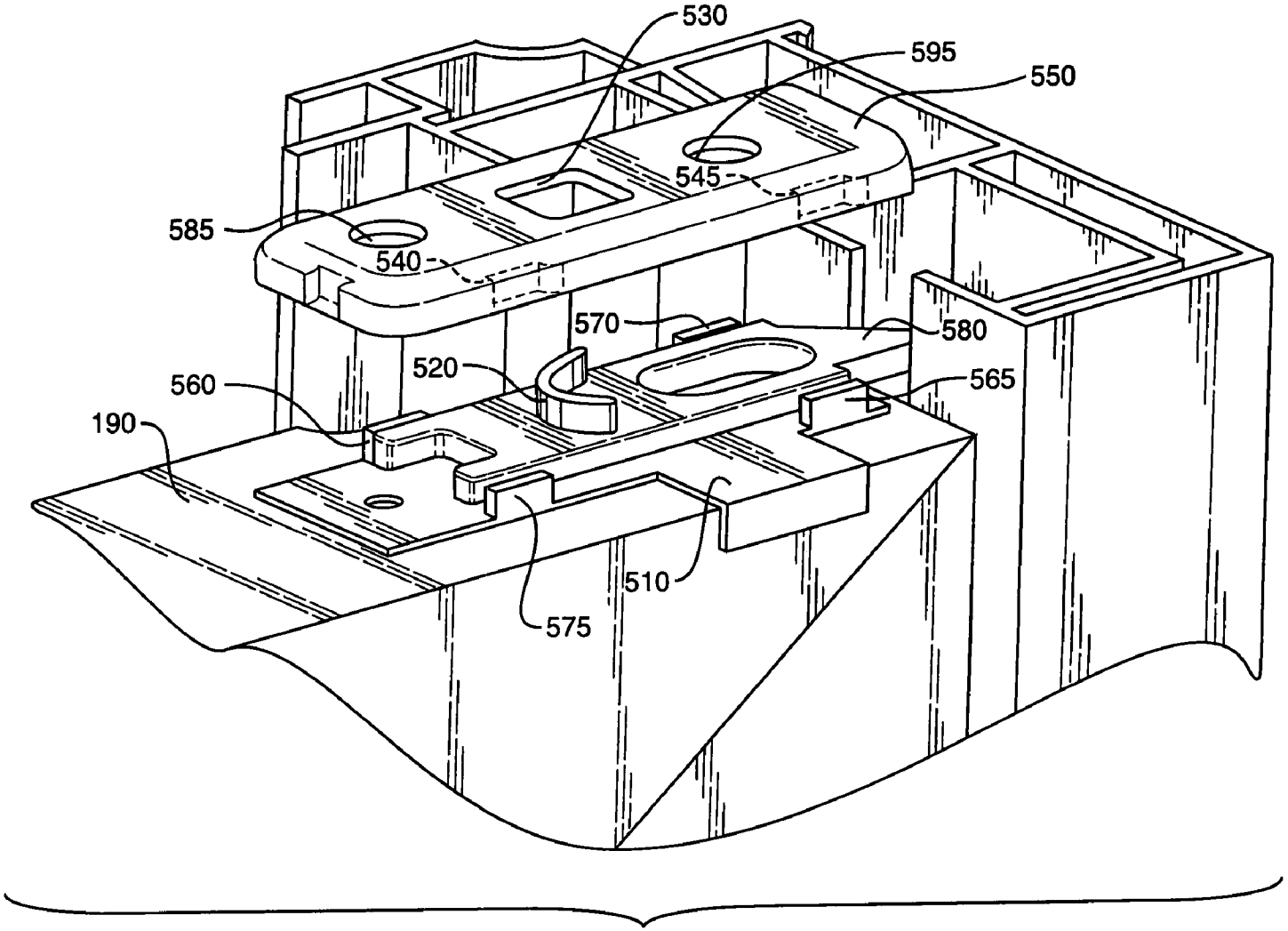
FIG. 5 is a perspective view of an alternate embodiment of the high load window sash latch that employs a separate housing wrap, secured to a window sash, as viewed from the interior face of the window sash.

Referring now to FIG. 5, the housing and housing wrap may alternately be constructed as two separate pieces. In such a two-piece design, a separate housing wrap 510 rests directly upon the window sash 190 and extends around an interior face of the sash. A latch bolt 580 slides upon the top surface of the separate housing wrap 510. Vertical ears 555, 560, 565, 570 of the housing wrap extend upward to define a path for the latch bolt 580, such that the bolt may travel within the path horizontally to extend into, or retract from, the window jamb 450, while other movement is restricted. The vertical ears 555, 560, 565, 570 may also interface with molded recesses 540, 545 (shown in dashed lines), in the housing 550, to help interconnect the housing wrap 510 and the housing 550. Other features of the two-piece design, such as finger pull 520 and opening 530, are similar to the corresponding features of the one-piece design of FIGS. 1 through 4. Screws may be used at locations 585 and 595 to hold the entire assembly together and to secure the assembly to the sash 190. As discussed previously, the screws may attach into non-reinforced ends of the sash.

The high load window sash latch in the one-piece embodiment is preferably constructed from impact resistant plastic. Impact resistant plastic is lightweight, relatively inexpensive and is resistant to cracking, breaking and other damage when subject to forces and extended use. Alternately, the window sash latch may be constructed from a light-weight metal, such as, for example, aluminum, steel, or die cast zinc. In the two-piece embodiment, the window sash latch is preferably constructed from a combination of materials. The housing is preferably constructed from impact resistant plastic and the separate housing wrap is preferably constructed from a metal for increased strength. The use of other materials is expressly contemplated though.

Figure 6:
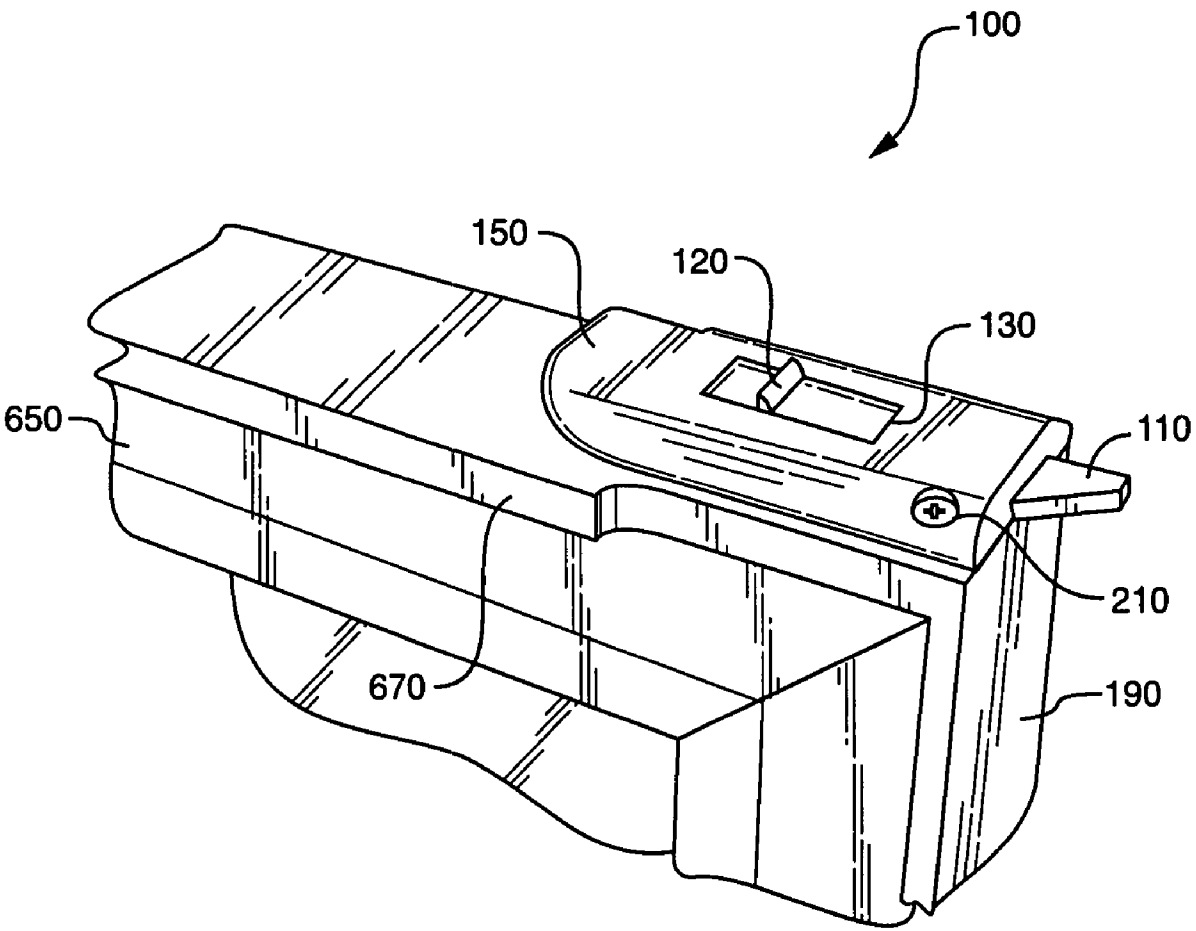
FIG. 6 is a perspective view of a window sash, as viewed from the exterior face of the window sash, showing in particular a meeting rail interlock.

The high load window sash latch may be employed with an otherwise conventional window system, or with a window system that includes other structural features suited to withstanding wind forces. One such structural feature is interlocking meeting rails. Referring to FIG. 6, an interlocking meeting rail 650 of a sash of a double-hung window system may include a U-shaped channel 670 along the sash's edge, configured to engage a similar receiving channel on the meeting rail of an upper sash (not shown). The interlocking meeting rails effectively couple the sashes together, distributing wind forces more evenly between the two sashes.

Further variations may be made to the described embodiments, and some or all of the advantages of the invention may be achieved. For example, while the illustrative embodiment depicts a double-hung window, the sash latch may also be adopted for use with other types of windows, such as, for example, casement windows or single-hung windows with only one movable sash. Similarly, while the illustrative embodiment depicts various screws, it is understood that other types of fasteners, such as, for example, bolts, may be used. Further, while the illustrative embodiment shows the latch bolt positioned on or above the top surface of the window sash, it is contemplated that the latch bolt could be partially or fully recessed in a groove or channel formed in the top surface of window sash. In such a configuration, the groove or channel may partially stabilize the latch bolt. Accordingly, the foregoing descriptions are to be taken only by way of example and not to otherwise limit the scope of the invention. It is the object of the appended claims to cover all such variations and modifications as come within the true spirit and scope of the invention.

What is claimed is:

1. A window sash that includes a window sash latch for securing the window sash to a window jamb comprising:

a meeting rail of the window sash having a top face and a bottom face;

a window sash latch attached to the top face of the meeting rail, the window sash latch including a movable latch bolt adapted to interface with the window jamb and a latch housing having:

a) a channel that at least partially surrounds the latch bolt, the channel permitting horizontal travel of the latch bolt such that the latch bolt may be extended into, or retracted from, the window jamb, the channel restraining the latch bolt from movement in two or more other directions, and b) a housing wrap integral to the latch housing, the housing wrap extending around and down a portion of an interior face of the window sash; and one or more fasteners for interconnecting the latch housing and the meeting rail of the window sash, wherein the latch housing and integral housing wrap operate to transfer force between the window sash and the window jamb through the latch bolt.

2. The window sash of claim 1 further comprising:

a spring attached to the latch bolt and adapted to hold the latch bolt extended into the window jamb.

3. The window sash of claim 1 wherein the housing wrap portion of the latch housing is adapted to receive a positive force incident on the window sash and operates to transfer the positive force to the rest of the latch housing.

4. The window sash of claim 1 wherein the bottom surface of the latch bolt contacts and moves along the top face of the meeting rail of the window sash.

5. The window sash of claim 4 wherein the top face of the meeting rail of the window sash restrains the latch bolt from movement in a downwards direction, while not restraining the latch bolt from movement in a first sidewise direction orthogonal to the direction of horizontal travel of the latch bolt and in a second sideways direction orthogonal to the direction of horizontal travel of the latch bolt.

6. The window sash of claim 1 wherein at least one of the one or more fasteners extends through the latch housing into the meeting rail of the window sash and operates to transfer a negative force incident on the window sash to the latch housing.

7. The window sash of claim 1 wherein at least one of the one or more fasteners extends through the latch housing into the meeting rail of the window sash and is positioned near the exterior face of the window sash proximate to the window jamb.

8. The window sash of claim 1 wherein the latch bolt and latch housing are constructed from an impact resistant plastic.

9. The window sash of claim 1 wherein the latch bolt and latch housing are constructed from a material selected from the group consisting of aluminum, steel, and die cast zinc.

10. The window sash of claim 1 wherein the latch bolt is adapted to interface with a track of the window jamb, the track extending at least partially the height of the window jamb, the track permitting vertical movement of the latch bolt while preventing inward and outward horizontal movement of the bolt.

11. The window sash of claim 1 wherein the window sash is a double-hung window sash.

12. The window sash of claim 1 wherein the window sash is a single-hung window sash.

13. The window sash of claim 1 wherein the channel of the latch housing surrounds at least portions of a top surface, a first side surface, and a second side surface of the latch bolt.

14. The window sash of claim 1 wherein the channel of the latch housing directly contacts at least portions of a top surface, a first side surface, and a second side surface of the latch bolt, the channel of the latch housing restraining the latch bolt from movement in an upwards direction, from movement in a first sidewise direction orthogonal the first side surface, and from movement in a second sideways direction orthogonal to the second side surface.

15. A window sash that includes a window sash latch for securing the window sash to a window jamb comprising:

a meeting rail of the window sash having a top face and a bottom face;

a window sash latch attached to the top face of the meeting rail, the window sash latch including:

a) a movable latch bolt adapted to interface with the window jamb;

b) a housing wrap, positioned on a top surface of the window sash and extending around and down a portion of an interior face of the window sash, the housing wrap including one or more upwardly extending vertical ears that provide a path for the latch bolt to travel horizontally in, such that the latch bolt may be extended into, or retracted from, the window jamb, the vertical ears further restraining the bolt from movement in one or more other directions;

c) a separate latch housing at least partially surrounding the latch bolt; and one or more fasteners interconnecting the housing wrap, latch housing, and meeting rail of the window sash, wherein the housing wrap operates to transfer force between the window sash and the window jamb through the latch bolt.

16. The window sash of claim 15 wherein the latch housing is constructed from an impact resistant plastic and the housing wrap is constructed from a metal.

17. The window sash of claim 15 wherein the vertical ears directly contact at least a first side surface and a second side surface of the latch bolt, the vertical ears restraining the latch bolt from movement in a first sidewise direction orthogonal to the first side surface and from movement in a second sideways direction orthogonal to the second side surface.

18. The window sash of claim 15 wherein the separate latch housing directly contacts at least portions of a top surface of the latch bolt, the separate latch housing restraining the latch bolt from movement in an upwards direction.

19. A window sash comprising:

a meeting rail of the window sash having a top face and a bottom face;

means for latching arranged above the top face of the meeting rail of the window sash, the means for latching adapted to interface with the window jamb;

means for providing a path for horizontal travel of the means for latching, such that the means for latching may move along the path to extended into, or retracted from, interfacing with the window jamb, the means for providing a path further preventing the means for latching from moving in two or more other directions; and a housing wrap that extends around and down a portion of an interior face of the window sash, wherein the housing wrap operates to transfer force between the window sash and the means for latching.

20. The window sash of claim 19 further comprising:

means for fastening the housing wrap to the window sash.

* * * * *